US005450827A

United States Patent [19]

Kang

[11] Patent Number: 5,450,827

[45] Date of Patent: Sep. 19, 1995

[54] ALUMINUM ALLOY CYLINDER BLOCK FOR AN INTERNAL COMBUSTION ENGINE

[75] Inventor: Bo K. Kang, Suwon, Rep. of Korea

[73] Assignee: Hyundai Motor Company, Ulsan, Rep. of Korea

[21] Appl. No.: 358,002

[22] Filed: Dec. 16, 1994

[30] Foreign Application Priority Data

Dec. 17, 1993 [KR] Rep. of Korea ..... 93-28237 U

[51] Int. Cl.[6] ..... F02F 7/00

[52] U.S. Cl. ..... 123/193.2; 123/668

[58] Field of Search ..... 123/195 R, 193.2, 668

[56] References Cited

U.S. PATENT DOCUMENTS

| | | | |
|---|---|---|---|
| 3,069,209 | 12/1962 | Bauer | 309/3 |
| 3,439,586 | 4/1969 | Holtan et al. | 92/169 |
| 3,561,104 | 2/1971 | Holtan et al. | 29/527.6 |
| 4,738,298 | 4/1988 | Taruno et al. | 164/97 |
| 4,757,790 | 7/1988 | Ushio et al. | 123/193.2 |
| 4,759,317 | 7/1988 | Ampferer | 123/41.74 |
| 4,831,712 | 5/1989 | Suzuki et al. | 29/527.6 |
| 4,856,462 | 8/1989 | Ushio et al. | 123/668 |
| 4,903,652 | 2/1990 | Field et al. | 123/193.2 |
| 4,905,642 | 3/1990 | Suzuki et al. | 123/668 |
| 5,005,469 | 4/1991 | Ohta | 92/169.4 |

*Primary Examiner*—Noah P. Kamen

*Attorney, Agent, or Firm*—Birch, Stewart, Kolasch & Birch

[57] ABSTRACT

An aluminum alloy cylinder block for an internal combustion engine includes a pair of liners fit within a pair of symmetrically disposed grooves which are formed on an inner peripheral surface of each of a plurality of piston cylinders and not overlapping a connector joining adjacent ones of the plurality of piston cylinders whereby the cylinder block can be reduced in weight, size and length thereof and its durability extended.

5 Claims, 1 Drawing Sheet

ALUMINUM ALLOY CYLINDER BLOCK FOR AN INTERNAL COMBUSTION ENGINE

BACKGROUND OF THE INVENTION

1. Field of the Invention

The present invention relates to an aluminum alloy cylinder block for an internal combustion engine and, more particularly, to a pair of high carbon steel liners symmetrically disposed in grooves which are formed in an inner peripheral surface of each of a plurality of piston cylinders thereof for reducing weight of the cylinder block.

2. Description of Related Art

Various types of cylinder blocks made of cast iron are known in the art because such cast iron cylinder blocks have good anti-abrasion and anticorrosion properties, and are easy and inexpensive to manufacture.

Most recently, in order to reduce the weight of the cylinder block, as shown in FIG. 1, the cylinder block 1 is made of aluminum alloy and a one-piece continuous cylindrical liner 3 of high carbon steel is disposed on an inner peripheral surface of each cylinder 2 of cylinder block 1.

However, a wall between adjacent cylinders 2 of this cylinder block 1 is thick since the wall includes two liners and the inner peripheral surface for two liners, so that the aluminum alloy cylinder block 1 increases in length, size and weight. Furthermore, the cylinder liner 3 can be extended by reciprocating motion of the piston and friction of the piston ring. Therefore, the crank shaft, cylinder head and cam shaft will be extended.

SUMMARY OF THE INVENTION

Accordingly, it is an object of the present invention to provide an aluminum alloy cylinder block for an internal combustion engine, which eliminates the above problems encountered in conventional aluminum alloy cylinder blocks.

Another object of the present invention is to provide an improved aluminum alloy cylinder block including a pair of high carbon steel liners with symmetrically disposed grooves which are formed on an inner peripheral surface of each of a plurality of piston cylinders thereof for reducing weight, size and length of the cylinder block.

A further object of the present invention is to provide a two-piece symmetrical liner fit within an inner peripheral wall of each piston cylinder opening of the cylinder block for increasing anti-abrasion and anticorrosion thereof and extending durability of the internal combustion engine.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an aluminum alloy cylinder block for an internal combustion engine comprising a pair of liners fit within a pair of symmetrically disposed grooves which are formed on an inner peripheral surface of each of a plurality of piston cylinders and not overlaying connector pieces connecting adjacent ones of the piston cylinders, whereby the cylinder block can be reduced in weight, size, and length and extended durability thereof can be obtained.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

It has been discovered by the inventor(s) that no friction occurs at an inner peripheral wall portion of a plurality of piston cylinders at a portion corresponding to an arcuate length of a connector piece formed between adjacent ones of the plurality of piston cylinders. Accordingly, the present invention advantageously utilizes the inventor's discovery as will be more fully explained in the following detailed description.

Figure 2:
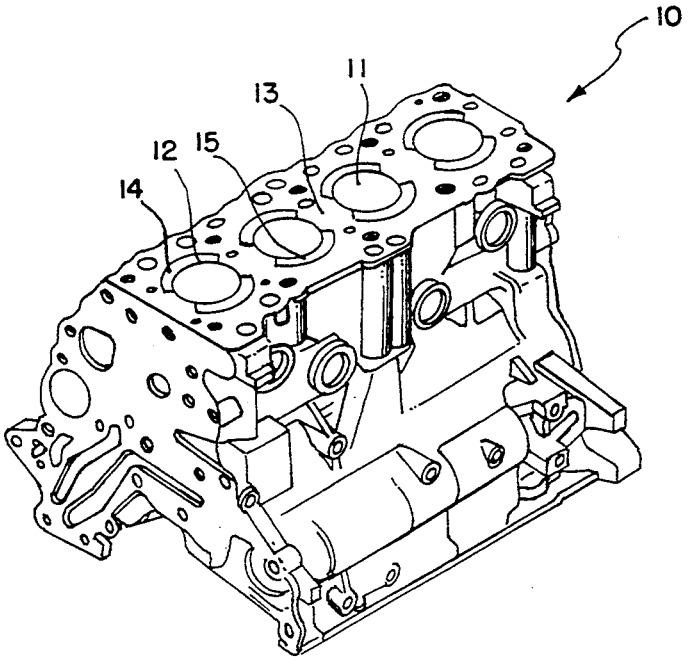
FIG. 2 is a perspective view of a cylinder block for an internal combustion engine according to the present invention.
Figure 3:
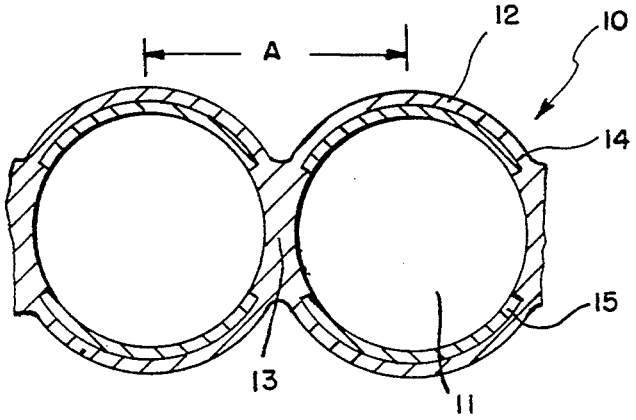
FIG. 3 is a partial cross-sectional view of a cylinder block according to the present invention.

Referring now in detail to the drawings for the purpose of illustrating preferred embodiments of the present invention, the aluminum alloy cylinder block 10 for an internal combustion engine as shown in FIGS. 2 and 3, comprises a plurality of piston cylinders 12 formed in the cylinder block 10 and made of an aluminum alloy. Each of the plurality of piston cylinders 12 includes a piston opening 11, a connector piece 13 for connecting adjacent piston cylinders 12 and a pair of symmetrically disposed grooves 14 formed on an inner peripheral surface of each piston cylinder and not overlaying or overlapping the connector piece 13.

A pair of lining members 15 are fit within the pair of symmetrically disposed grooves 14, respectively, such that the connector piece 13 is free of surface coverage by the pair of lining members 15. The pair of lining members 15 are made of high carbon steel and symmetrically oppose each other. Each of the lining members 15 is arcuate in shape to correspond to the inner peripheral shape of the piston cylinders 12 and is of a length to leave portions of the inner wall equal in arcuate length of the connector piece 13 free of the liner member 15. The pair of lining members 15 are fit within the symmetrically formed grooves 14 with a suitable bonding method such as an adhesive agent, welding, friction fit or the like.

Figure 1:
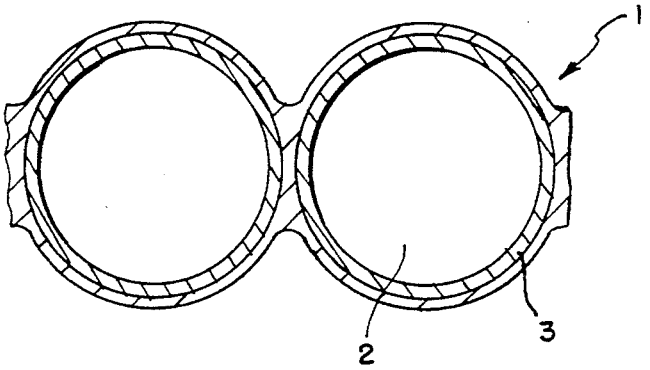
FIG. 1 CONVENTIONAL ART
FIG. 1 is a partial cross-sectional view of a conventional cylinder block.

Accordingly, no friction of a piston (not shown) occurs at the inner peripheral wall portions of the cylinder piston block 12 which substantially correspond to the arcuate length of the connector piece 13 such that lining at this portion is not necessary. A further benefit is that the thickness of the connector piece 13 is reduced due to the absence of liner members 15 thereover compared with the conventional cylinder block 1 (FIG. 1). As a result, a length A between longitudinal axes of adjacent piston cylinders 12 is reduced (FIG. 3). Therefore, the cylinder block 10 according to the present invention is reduced weight, size and length thereof and will have extended durability. Furthermore, a longitudinal length of the internal combustion engine is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An aluminum alloy cylinder block for an internal combustion engine comprising:

a plurality of cylinder piston blocks formed in said cylinder block, each of said plurality of cylinder piston blocks including a piston opening formed therein;

means for connecting adjacent ones of said plurality of cylinder piston blocks;

a pair of symmetrically disposed grooves formed on an inner peripheral surface of each of said plurality of cylinder piston blocks and not overlapping said means for connecting; and a pair of lining members fit within said pair of symmetrically disposed grooves, respectively, such that said means for connecting is free of said pair of lining members.

2. The aluminum alloy cylinder block according to claim 1, wherein said pair of lining members are made of high carbon steel.

3. The aluminum alloy cylinder block according to claim 1, wherein said pair of lining members fit within said grooves by means of an adhesive agent.

4. The aluminum alloy cylinder block according to claim 1, wherein a thickness of said means for connecting is less than that of a conventional aluminum cylinder block.

5. The aluminum alloy cylinder block according to claim 1, wherein said means for connecting is a connector formed by joining continuously outer peripheral surfaces of adjacent ones of said plurality of cylinder piston blocks.

* * * * *